US005126638A

United States Patent [19]

Dethlefsen

[11] Patent Number: 5,126,638

[45] Date of Patent: Jun. 30, 1992

[54] COAXIAL PSEUDOSPARK DISCHARGE SWITCH

[75] Inventor: Rolf Dethlefsen, San Diego, Calif.

[73] Assignee: Maxwell Laboratories, Inc., San Diego, Calif.

[21] Appl. No.: 699,476

[22] Filed: May 13, 1991

[51] Int. Cl.[5] ..... H01J 17/04; H01T 2/00

[52] U.S. Cl. ..... 315/326; 315/111.01; 313/231.41; 328/251

[58] Field of Search ..... 315/326, 362, 111.01; 313/360.1, 231.41; 328/251

[56] References Cited

U.S. PATENT DOCUMENTS

| | | | |
|---|---|---|---|
| 3,471,733 | 10/1969 | Rich | 313/217 |
| 3,509,406 | 4/1970 | Rich | 313/155 |
| 4,280,098 | 7/1981 | Veraldi | 328/59 |
| 4,291,255 | 9/1981 | Alexoff | 313/231.41 X |
| 4,335,465 | 6/1982 | Christiansen et al. | 313/360.1 X |
| 4,360,763 | 11/1982 | Gryzinski | 315/111.01 |
| 4,394,622 | 7/1983 | Rink | 377/115 |
| 4,442,383 | 4/1984 | Hill | 315/326 X |
| 4,498,183 | 2/1985 | Levatter | 313/231.41 X |
| 4,507,589 | 3/1985 | Prono | 315/111.01 |
| 4,727,298 | 2/1988 | Mendel | 315/111.01 X |
| 4,970,433 | 11/1990 | Thayer, III | 315/111.01 |
| 5,038,082 | 8/1991 | Arita et al. | 315/326 |

FOREIGN PATENT DOCUMENTS

| | | |
|---|---|---|
| 0203551 | 1/1956 | Australia . |
| 0865617 | 7/1949 | Fed. Rep. of Germany . |

OTHER PUBLICATIONS

Merchtersheimer et al., "Multichannel Pseudo-Spark Switch (MUPS)", *Journal of Physics, 'E'*, 20:270–273 (1987).

Frank, et al., "High-Power Pseudospark and BLT Switches", *IEEE Transactions on Plasma Science*, 16(2):317–323 (Apr. 1988).

Kozlik et al., "Triggered Low-Pressure Pseudospark-Based High Power Switch", *IEEE Transactions on Plasma Science*, 17(5):758–761 (Oct. 1989).

Frank, et al., "The Fundamentals of the Pseudospark and Its Applications", *IEEE Transactions on Plasma Science*, 17(5):748–753 (Oct. 1989).

Bloess, et al., "The Triggered Pseudospark Chamber as a Fast Switch and as a High-Intensity Beam Source", *Nucl. Instrum. Methods*, 205:173–184 (1983).

Kirkman, et al., "Low pressure, light initiated, glow discharge switch for high power applications," *Appl. Phys. Lett.* 49:494–495 (1986).

(List continued on next page.)

*Primary Examiner*—Eugene R. Laroche
*Assistant Examiner*—Do Hyum Yoo
*Attorney, Agent, or Firm*—Fitch, Even, Tabin & Flannery

[57] ABSTRACT

A high power pseudospark switch (40) utilizes a coaxial cylindrical electrode geometry to provide a large number of pseudospark discharge channels (60) in a compact space. The coaxial cylindrical electrode geometry includes a hollow cylindrical anode (52) inside of a larger hollow cylindrical cathode (54). A plurality of radially aligned holes (57, 59) are equally spaced around the perimeter of both the hollow anode and cathode, thereby forming an annular pseudospark discharge (PSD) channel about the coaxial center axis. A plurality of such PSD channels (56, 58) are then stacked along the length of the coaxial cylindrical electrode geometry. A single trigger pulser (48) aligned with the center axis of the cylindrical electrodes provides a way for simultaneously triggering a discharge in each PSD channel. An outer switch housing, divided into two electrically-insulated portions (47, 49) surrounds the coaxial cylindrical electrodes and provides a structural support for the electrodes as well as an electrical contact with the electrodes. A non-conductive seal (43) positioned between the respective housing portions maintains electrical isolation between the respective electrodes, and further allows a specified gas to be maintained within the switch housing at a prescribed pressure, thereby promoting operation of the device on the left side of the Paschen curve.

22 Claims, 3 Drawing Sheets

OTHER PUBLICATIONS

Kirkman, et al., "Flash-lamp-triggered high-power thyratron-type switch," *Appl. Phys. Lett., 52(8):613-615 (1988).*

Mechtersheimer, et al., "High repetition rate, fast current rise, pseudo-spark switch," *J. Phys. E: Sci. Instru.* 19:466-470 (1986).

Benker, et al., "Generation of Intense pulsed Electron Beams by the Pseudospark Discharge," *IEEE Transactions on Plasma Science,* 17(5):754-757 (1989).

Braun, et al., "Fiber-Optic-Triggered High-Power Low-Pressure Glow Discharge Switches," *IEEE Transactions Electron Devices,* 35(4):559-562 (1988).

Gundel, et al., "Low-pressure hollow cathode switch triggered by a pulsed electron beam emitted from ferroelectrics," *Appl. Phys. Lett,* 54(21):2071-2073 (1989).

COAXIAL PSEUDOSPARK DISCHARGE SWITCH

BACKGROUND OF THE INVENTION

The present invention relates to pseudospark discharge devices and methods, and more particularly to a coaxial pseudospark power switch having a compact, coaxial configuration that provides a pseudospark discharge at a plurality of discharge locations upon being triggered from an on-axis trigger location.

The breakdown voltage between two parallel plane electrodes is a function of the product of the distance d between the electrodes and the gas pressure p in the region between the electrodes. This voltage is described by the well-known Paschen curve, presented below, which curve shows similar behavior for all kinds of gases.

For special geometries, i.e., spaced apart planar electrodes having an aligned central hole, it has been shown that a different type of discharge exists in the region on the Paschen curve between the Paschen minimum and the vacuum breakdown. This discharge is characterized more as a glow rather than an arc, and is referred to as a "pseudospark". See, e.g., Frank, et al., "The Fundamentals of the Pseudospark and Its Applications,", *IEEE Transactions on Plasma Science,* Vol. 17, No. 5, pp. 748–53 (October 1989).

A pseudospark discharge switch is a discharge device that provides a diffuse plasma discharge, i.e., a pseudospark, between two planar electrodes having an aligned central hole immersed in a low pressure gas environment. The low pressure gas environment assures operation on the left side of the Paschen curve. Triggering of the pseudospark switch is controlled by any suitable mechanism that increases the charge carrier density in the region of the electrodes. If triggered electrically, a pseudospark device is typically referred to as a pseudospark switch. If triggered optically, a pseudospark device is sometimes referred to as a back-lighted thyraton (BLT). As used herein, the terms "pseudospark" or "pseudospark switch" are intended to refer to any type of diffuse discharge device operating on the left side of the Paschen curve, regardless of how the device is triggered.

The main advantage of the pseudospark discharge device is its ability to rapidly switch large currents at high voltages in a low pressure gas environment. Thus, the pseudospark discharge switch can be used to replace triggered gas gap breakdown switches, rotating arc switches, and other high current switching devices.

Further, because the pseudospark discharge represents a very rapid breakdown phase, the discharge operates with an anomalously high cold-cathode emission, which is much higher than the emission from a standard hot cathode. Thus, in addition to high power switching applications, the pseudospark discharge switch may be effectively used: (1) as a source of high-density beams of electrons, see Bloess et al., "The Triggered Pseudospark Chamber as a Fast Switch and as a High-Intensity Beam Source," *Nucl. Instrum. Methods,* Vol. 205, p. 173 (1983); (2) as a source of high-density beams of ions, see Bauer et al., "High Power Pseudospark as an X-ray Source," *Proc* 18th Int. Conf. on Phenomena in Ion Gases (Swansea, U.K.), pp. 4–718 (1987); (3) to generate laser radiation, Christiansen et al., "Pulsed Laser Oscillation at 488.0 nm and 514.5 nm in an Ar-He Pseudospark Discharge," *Optics Comm.,* Vol. 56, No. 1, p. 39 (1985); (4) to generate microwaves, J. Gundlach, "Microwave-excitation by a Pseudospark Electron Beam" (in German), Master thesis, Physics Institute, University of Duesseldorf, Duesseldorf, FRG (1986); and (5) to generate short duration X-ray flashes, P. Roehlen, "The Pseudospark Discharge as an Intense Source of Electron Beams" (in German), Master thesis, Physics Institute, University of Duesseldorf, Duesseldorf, FRG (1985).

In order to increase the discharge capacity of a pseudospark device, it is known in the art to construct a multigap pseudospark chamber, comprising stacked spaced-apart electrodes having central holes, as shown, e.g., in the Frank et al. reference cited above. It is also known in the art to connect two or more pseudospark devices in parallel, or to make a multichannel pseudospark (MUPS) switch (which is effectively the equivalent of parallel-connected pseudospark switches sharing a common cathode and anode plate), as taught, e.g., in Mechtersheimer et al., "Multichannel Pseudo-Spark Switch (MUPS)," *J. Phys. E: Sci. Instrum.,* Vol. 20, pp. 270–73 (1987).

Unfortunately, multi-gap pseudospark devices, MUPS switches, or a network of pseudospark discharge switches connected in parallel, occupy a relatively large volume. Further, a network of parallel pseudospark devices requires a rather sophisticated trigger mechanism and control circuit in order to assure that all of the pseudospark switches are triggered at the same time. Thus, despite the numerous advantages and versatility of the pseudospark discharge device, there remains a need in the art for a more compact pseudospark discharge geometry that has the same or higher discharge capacity as the larger volume multichannel or parallel-connected pseudospark discharge devices, and that is easily triggered using a single trigger control signal.

Moreover, all pseudospark switch geometries must use some sort of insulator in order to separate the anode from the cathode. If this insulator is near the discharge path, i.e., in the vicinity of the aligned hole of the electrodes, then it is possible that discharge products may accumulate on, and hence eventually coat, the insulator, thereby adversely affecting its insulative properties and degrading switch performance. What is also needed, therefore, is a pseudospark switch geometry that prevents discharge products from accumulating on the electrode insulator.

Further, a pseudospark switch design of low inductance is needed in order to allow large currents to be switched at high speed.

The present invention advantageously addresses the above and other needs.

SUMMARY OF THE INVENTION

The present invention provides a high power pseudospark discharge apparatus or switch, and method of generating a pseudospark discharge, that utilizes a unique coaxial cylindrical electrode geometry to yield a large number of pseudospark discharge (PSD) channels in a compact space. Further, a single trigger pulser aligned with the center axis of the cylindrical electrode geometry provides a convenient means for simultaneously triggering a discharge in each PSD channel. Moreover, the coaxial electrode geometry further positions an insulator, used to hold the coaxial electrodes in a spaced-apart relationship, far removed from the discharge path, thereby preventing discharge products from accumulating thereon.

In accordance with one aspect of the invention, the discharge capacity of the coaxial PSD switch is increased by using a coaxial cylindrical electrode geometry that includes a first hollow cylindrical electrode, e.g, an anode, inside of a second larger hollow cylindrical electrode, e.g., a cathode. The electrodes are structurally supported so as to maintain a desired spacing therebetween, e.g., 2–6 mm. A plurality of radially aligned holes, e.g., twelve, are equally spaced around the perimeter of both the hollow anode and cathode, thereby forming an annular PSD channel about the coaxial center axis. Advantageously, such annular PSD channel offers the discharge equivalent of a linear multichannel pseudospark switch having the same hole spacing of length $2\pi r$, where r is the average radius of the coaxial electrodes. However, the coaxial structure offers the further advantage of providing a multichannel discharge at a much reduced inductance due to the symmetry of the electrode structure, which symmetry also better balances the magnetic forces and fields that are developed during the discharge.

In accordance with another aspect of the invention, the discharge capacity of the coaxial PSD switch is further increased by stacking a plurality of such PSD annular channels along the length of the coaxial cylindrical electrode geometry. Thus, for example, if five such annular PSD channels are included along the length of the coaxial electrodes, and assuming 12 holes around the circumference of each annular PSD channel, a discharge capacity equal to 60 single channel (single hole) pseudospark switches is achieved in an extremely compact volume.

In accordance with yet another aspect of the invention, the coaxial PSD switch offers very low inductance, thereby facilitating high switching rates. Low inductance is achieved in part by the symmetrical geometry of the electrode structures, as mentioned above. Further, the coaxial electrodes are surrounded with a switch housing, or outer shell, divided into two electrically-insulated portions. Such seal housing advantageously provides a convenient means of structural support for the electrodes, as well as a convenient means for making electrical contact with the electrodes. Further, the parallel plates of a flat plate transmission line may be readily connected to extensions of the housing portions, thereby facilitating the delivery of power to and from the pseudospark switch through low inductive paths.

Still another aspect of the invention assures that the coaxial PSD switch operates on the left hand side of the Paschen curve. This is accomplished by sealing a specified gas within the housing at a prescribed pressure. Such sealing is realized with a non-conductive seal positioned between the respective housing portions. This seal not only seals the housing so that a specified gas can be maintained therewithin at a prescribed pressure, but also maintains electrical isolation between the respective shell portions, and hence between the coaxial electrodes. Further, the location of such insulating seal is such that it is far removed from the discharge path, thereby preventing discharge products from accumulating on the seal.

It is noted that there are various embodiments and configurations that may be used to practice the invention. One such embodiment may be characterized as a coaxial pseudospark discharge (PSD) switch. Another embodiment may be characterized as apparatus for generating a pseudospark discharge. Still another embodiment may be considered as a method of generating a pseudospark discharge. Each of these embodiments are briefly summarized below.

The embodiment comprising a coaxial pseudospark discharge (PSD) switch may be broadly characterized as including: (1) a sealed housing having a central axis, such housing having a specified gas maintained therein at a prescribed pressure, and such housing being made from first and second sections that are maintained in electrical isolation from each other; (2) a first, hollow, cylindrical electrode mounted inside of the housing so as to be in alignment with the central axis and in electrical contact with the first housing section; (3) a second, hollow, cylindrical electrode mounted inside of the housing so as to overlap and be coaxial with, yet spaced-apart from, the first cylindrical electrode, there being a uniform gap between an outer surface of the first cylindrical electrode and an inner surface of the second cylindrical electrode, the second cylindrical electrode further being in electrical contact with the second housing section; (4) at least one PSD channel, each PSD channel comprising a multiplicity of holes uniformly spaced around the circumference of the first and second cylindrical electrodes, each hole in the first cylindrical electrode of the PSD channel being radially aligned with a corresponding hole in the second cylindrical electrode of the PSD channel; (5) means for applying a prescribed voltage potential between the first and second housing sections, whereby the prescribed voltage potential is placed between the spaced-apart cylindrical electrodes; and (6) triggering means for selectively triggering a pseudospark discharge between the spaced-apart cylindrical electrodes. Advantageously, the uniform spacing and prescribed gas pressure and voltage potential promote a pseudospark discharge in response to the triggering means. This pseudospark discharge tends to center itself on a radial axis passing through the radially aligned holes of the first and second cylindrical electrodes. Further, through the use of such a PSD switch, a large pseudospark discharge, e.g., on the order of mega ($10^6$) amperes, may be selectively passed between the first and second housing sections, thereby functioning as a switch that momentarily connects the first and second housing sections together so that a desired discharge (current) can flow therebetween.

The embodiment of the invention comprising apparatus for generating a pseudospark discharge may be characterized as including: (1) coaxial cylindrical electrodes comprising (a) a first, hollow, cylindrical electrode, (b) a second, hollow, cylindrical electrode coaxial with and overlapping the first cylindrical electrode, thereby forming an overlapping electrode portion, with a uniform gap existing between an outer surface of the first cylindrical electrode and an inner surface of the second cylindrical electrode, and (c) a multiplicity of holes uniformly spaced around the circumference of the first and second cylindrical electrodes, each hole in the first cylindrical electrode being radially aligned with a corresponding hole in the second cylindrical electrode, this multiplicity of holes comprising a PSD channel; (2) means for maintaining a prescribed gas at a prescribed pressure in the gap between the first and second coaxial electrodes; (3) means for applying a prescribed voltage potential between the first and second cylindrical electrodes; and (4) triggering means centrally positioned at one end of the coaxial electrodes for selectively triggering a pseudospark discharge between the spaced-apart cylindrical electrodes. The desired pseudospark discharge occurs in response to the triggering means. Advantageously, the pseudospark discharge tends to center itself on a radial axis passing through each of the radially aligned holes of the first and second cylindrical electrodes, thereby directing the discharge so that it can be used for a desired purpose.

The embodiment of the invention comprising the method for generating a pseudospark discharge may be characterized as including the following steps: (a) forming overlapping cylindrical coaxial electrodes including a first, hollow, cylindrical electrode and a second, hollow, cylindrical electrode coaxial with and overlapping the first cylindrical electrode, and uniformly spacing a multiplicity of holes around the circumference of the first and second cylindrical electrodes so that each hole in the first cylindrical electrode is radially aligned with a corresponding hole in the second cylindrical electrode, such multiplicity of holes comprising a PSD channel; (b) maintaining a prescribed gas at a prescribed pressure in the gap between the first and second coaxial electrodes; (c) applying a prescribed voltage potential between the first and second cylindrical electrodes; and (d) selectively increasing the charge carrier density in the central region of the coaxial electrodes in order to trigger a pseudospark discharge between the first and second cylindrical electrodes. The increased charge carrier density, coupled with the gap spacing, prescribed gas pressure and voltage potential, promote a discharge on the left branch of the Paschen curve, i.e., promote a pseudospark discharge. The pseudospark discharge tends to center itself on a radial axis passing through each of the radially aligned holes of the first and second cylindrical electrodes.

It is thus a feature of the present invention to provide a high power switch that offers all of the advantages that a pseudospark discharge (PSD) device offers relative to conventional gas filled or triggered spark gap switches, e.g., reduced contact erosion, greater charge transfer, longer switch life, reduced internal pressure, faster repetition rates, reduced trigger energy, reduced housing strength, etc.

It is an additional feature of the invention to provide a coaxial PSD switch that offers many parallel PSD channels in a compact housing.

It is another feature of the invention to provide such a high power PSD switch that allows simultaneous triggering of many parallel PSD channels.

It is a further feature of the invention to provide a compact power PSD switch that utilizes a coaxial electrode structure that offers a small uniform gap over the regions of high electrical field strength while operating on the left branch of the Paschen curve.

It is yet an additional feature of the invention to provide such a compact coaxial PSD switch within a housing that facilitates matching with a low inductance transmission line.

It is another feature of the invention to provide a PSD switch wherein discharge products are prevented from coating electrode insulators.

It is still another feature to provide a compact coaxial PSD switch having a geometry that facilitates the introduction of water cooling or heat pipes.

It is a further feature of the invention to provide such compact PSD switch utilizing a coaxial electrode structure that provides a uniform current distribution, and wherein the self-magnetic fields due to current flow in the electrode structure do not distort the uniform current distribution.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
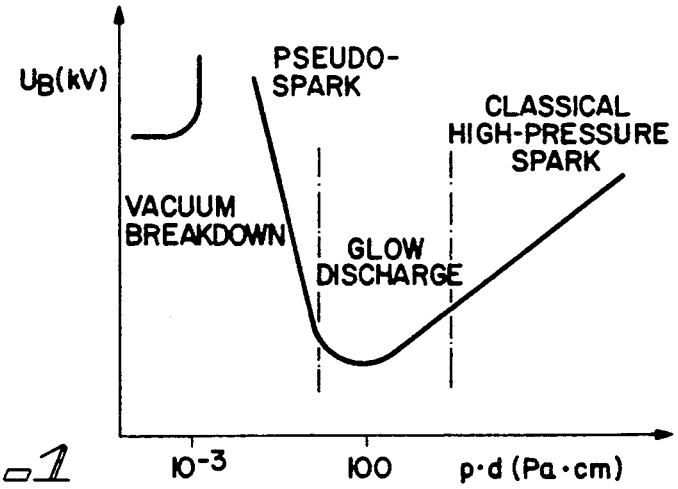
FIG. 1 shows a typical Paschen curve and illustrates the region of operation on such curve of a pseudospark device.

Before describing the particular coaxial geometry that is used in the pseudospark switch of the present invention, it will be helpful to review some basic operating principles associated with a pseudospark discharge (PSD) device. Thus, reference is first made to FIG. 1 where there is shown the electrical breakdown curve for gases as described by Paschen's law. Paschen's law may be simply stated as $$U_B = P \times d$$

where $U_B$ is the breakdown voltage, p is the pressure of the gas, and d is the effective separation or gap distance between the electrodes. As seen in FIG. 1, the breakdown curve is characterized by a nearly linear rise at pd-values above about 250 to 400 Pa.cm, a minimum at around 70 to 130 Pa.cm, and a steep rise below the minimum. (Note that "Pa" is the symbol for the "Pascal" the MKS unit of pressure, equal to one newton per square meter.)

As indicated in FIG. 1, breakdown in the region of the Paschen curve to the far right may be characterized as a classical high-pressure spark. Breakdown below about $10^{-3}$ Pa.cm is called vacuum breakdown. Breakdown near the minimum is referred to as a glow discharge. Breakdown in the region between the left of the Paschen minimum and the region of vacuum breakdown is referred to as a pseudospark. For purposes of the present invention, it is desirable for breakdown to occur in this region (referred to as the left side of the Paschen curve).

It is known in the art, see, e.g., Bloess et al., supra, that different physical mechanisms govern the discharge in the different regions of the Paschen curve. At high pressures, an electron avalanche expands very fast into a streamer discharge, or a "spark". Near the Paschen minimum, a glow discharge results from ionization by electrons and on the creation of electrons from electrode surfaces through ion impact. Vacuum breakdown, on the other hand may be characterized as primarily a surface phenomenon, where the carriers are liberated by desorption, ion-pact, and field emission, and then undergo acceleration and charge multiplication.

Figure 2:
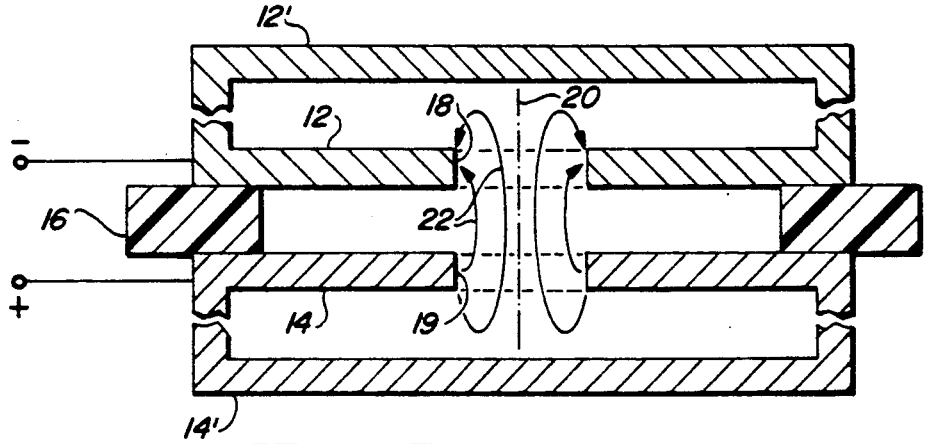
FIG. 2 (PRIOR ART)
FIG. 2 depicts the basic pseudospark switch geometry as taught in the prior art.

The pseudospark breakdown is a particular type of glow discharge induced in a specific geometrical configuration. The classical pseudospark configuration is shown in FIG. 2. As seen in FIG. 2, a first metal electrode 12, e.g. a cathode, is spaced apart from a second metal electrode 14, e.g. an anode, by means of an insulator 16. The cathode 12 and anode 14 have a center hole 18 and 19, respectively, aligned with a central hole axis 20. As needed, the electrodes 12 and 14 may be hollow, i.e., the electrodes may have a back 12' and 14', respectively, and corresponding sides in order to define a discharge cavity wherein a desired gas is maintained at a specified pressure.

When a pseudospark discharge is triggered, a positive charged beam is axially accelerated towards and through the anode hole 19, and an electron beam is similarly axially accelerated towards and through the cathode hole 18. Such an electron beam is schematically represented in FIG. 2 by the arrows 22.

Unlike a classical high-pressure spark, which typically seeks out the shortest path between two oppositely charged electrodes, a pseudospark discharge normally seeks out a long path between oppositely charged electrodes. The presence of the aligned holes in the respective electrodes thus provides a suitable long discharge path through which the pseudospark discharge may occur.

Any electrical discharge, including a pseudospark discharge, is usually accompanied by discharge products, e.g., conductive contaminants. After a sufficient number of such discharges, the discharge products tend to coat the surfaces of the electrodes and insulator(s) that are in the vicinity of the discharge. Disadvantageously, a build-up of such contaminants, i.e., a conductive coating on the inside surface of the insulator 16, causes the anode and cathode to electrically short together, thereby preventing the requisite voltage potential from being established between the electrodes, thus preventing further pseudospark discharges. As discussed more fully below, the coaxial electrode geometry herein disclosed avoids this problem by placing the insulator well away from the discharge path.

Figure 3:
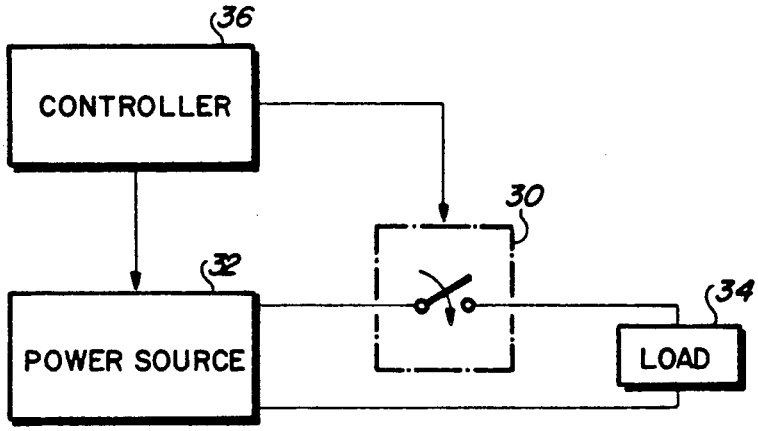
FIG. 3 is a block diagram showing the use of a pseudospark power switch to selectively deliver power to a load.

Referring next to FIG. 3, a block diagram is shown depicting the use of a pseudospark power switch 30 to selectively deliver a pulse of power from a power source 32 to a load 34. The pseudospark power switch 30 is functionally depicted in FIG. 3 as a switch having an open and a closed state. The closed state exists only during that time period when a pseudospark discharge exists between the electrodes of the switch 30. A pseudospark discharge is triggered by a suitable trigger pulse generated by a controller 36 whenever there is a sufficient voltage potential established between the electrodes of the switch 30 and whenever the gas pressure within the pseudospark switch is at a level that promotes a discharge along the left hand portion of the Paschen curve (FIG. 1).

The pseudospark discharge of the switch 30 continues for so long as the proper operating conditions are maintained (sufficient electrode potential and proper gas pressure). The open state of the switch 30 exists at all other times. Thus, the width or duration of the pseudospark discharge, upon being triggered by the controller 36, is actually controlled by the power source 32. That is, so long as the power source 32 can maintain the requisite voltage potential between the switch electrodes, the switch remains "closed". Because the current that flows from the power source 32 to the load 34 may be a very large current, e.g., on the order of $10^6$ amperes, and because the power source 32 typically comprises a charged-capacitor type of power source, an alternative way to view this operation is that the switch 30 remains closed, after being triggered, only for as long as the power source 32 can supply the requisite current to the load 34. Once the pseudospark discharge has occurred, i.e., once power has been delivered from the source to the load in accordance with the capacity of the power source 32, the switch 30 assumes its open position until such time as it again receives a trigger pulse from the controller 36 at a time when the requisite voltage potential is established between its electrodes.

One of the advantages of using a pseudospark discharge device as a high power switch as shown in FIG. 3 is the relatively rapid rate at which the switch can be operated. This rate can be increased even higher by transferring power through the switch to the load using flat plate transmission lines, or other similar configurations exhibiting very low inductance. The particular coaxial configuration of a pseudospark discharge device of the present invention advantageously facilitates the use of such low inductive transmission lines, as shown in FIG. 4.

Figure 4:
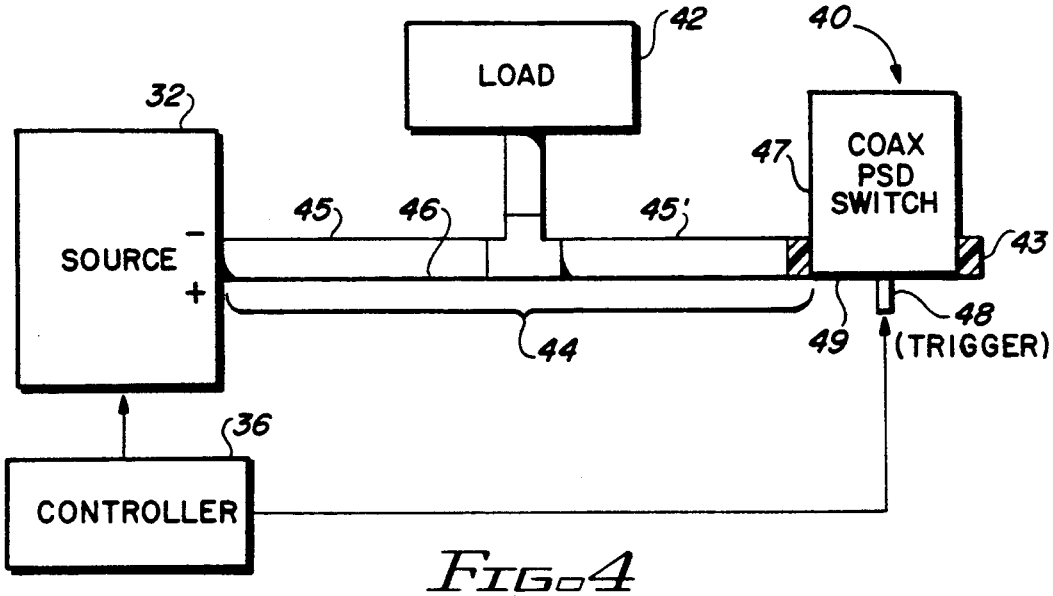
FIG. 4 schematically depicts the use of a coaxial pseudospark discharge switch made in accordance with the present invention to selectively connect a desired load to a power source by way of a flat plate transmission line.

FIG. 4 schematically depicts a coaxial pseudospark discharge device (PSD) made in accordance with the present invention that is used as a high power switch 40. The switch 40 is thus used to selectively connect a desired load 42 to a power source 32 by way of a flat plate transmission line 44. The configuration of the coax PSD switch 40 is detailed below in FIG. 5. Essentially, it comprises a sealed cylindrical housing having two portions, e.g., an upper portion 47 and a lower portion 49. These two portions are maintained in electrical isolation from each other by means of an insulator 43.

The flat plate transmission line 44 includes two conductors, schematically depicted in FIG. 4 as a pair of spaced-apart conductors 45 and 46. The conductor 45 connects, e.g., a negative terminal of the source 32 to one side of the load 42. A continuation of this conductor 45' connects the other side of the load 42 to the portion 47 of the coaxial PSD switch 40. A second of the flat plate transmission conductors 46 connects, e.g., a positive terminal of the source 32 directly to the other portion 49 of the coax PSD switch 40. As will be more evident from the description presented below in conjunction with FIG. 5, the two electrodes of the coax PSD switch 40 are connected to the top and bottom portions 47 and 49, respectively, of the PSD switch 40.

An on-axis trigger device 48 of the PSD switch 40 is connected to a controller 36. The controller 36 is also connected to the source 32. In operation, the source 32 (as controlled by the controller 36) develops a potential across the electrodes of the coax PSD switch 40. Upon receipt of a suitable trigger signal, applied to the trigger device 48, a pseudospark discharge occurs within the coax PSD switch 40 that rapidly transfers an electrical charge (e.g., an electrical current) between the portions 47 and 49 of the switch 40, thereby "closing" the switch 40. Once triggered, the switch 40 remains "closed" for so long as the conditions within the switch 40 support a pseudospark discharge on the left portion of the Paschen curve, i.e., for so long as the source maintains a voltage potential across the electrodes of the switch 40. Depending upon the power capacity of the source 32, and as controlled by the controller 36, this is usually a relatively short time, e.g., on the order of a few microseconds to a few hundred milliseconds. However, once a power pulse has been delivered to the load, the coax PSD switch 40 is able to rapidly recover so that it can be triggered again upon receipt of a new trigger pulse. Typically, the repetition rate of the power delivery system shown in FIG. 4, assuming that large pulsed currents on the order of $10^6$ amperes of microsecond to millisecond duration are delivered to the load, is limited by the recovery time of the power source 32, not by the coax PSD switch 40.

Figure 5:
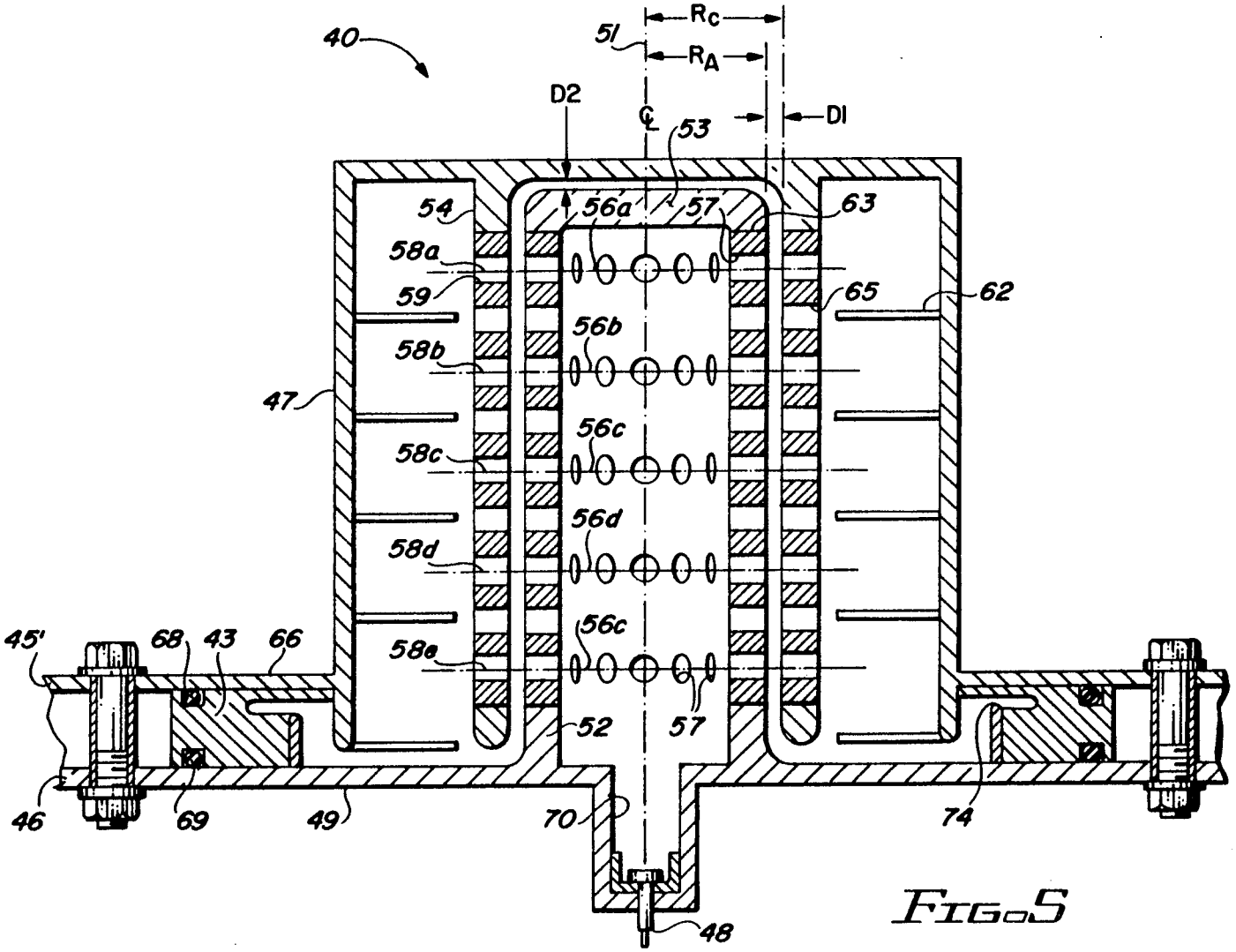
FIG. 5 is a side sectional schematic view of the coaxial pseudospark discharge switch of FIG. 4.

Referring next to FIG. 5, a side sectional schematic view of the coaxial PSD switch 40 of FIG. 4 is shown. In general, and unless indicated otherwise, this figure is scaled to illustrate the approximate correct proportions associated with the PSD switch 40. As suggested above, the coax PSD switch 40 includes a sealed cylindrical housing made up of a first portion 47 and a second portion 49, held in a spaced-apart relationship by an annular insulating ring 43. As shown in FIG. 5, the portion 47 is in the shape or form of an inverted upper cup or shell, whereas the portion 49 is in the shape or form of a lower or bottom plate that, in cooperation with the annular insulator 43, closes or seals the upper inverted cup 47. A suitable gas, such as hydrogen, helium, or argon is maintained within this sealed cylindrical housing at an appropriate pressure, e.g., 10 Pa.

A first hollow cylindrical electrode 52, e.g., an anode, is mounted to the lower plate 49 so as to be centered about a center line (longitudinal) axis 51 of the coax PSD switch 40. This first electrode 52 includes a closed end 53. A second hollow cylindrical electrode, e.g., a cathode, having an inside diameter slightly larger than an outside diameter of the first cylindrical electrode 52, is mounted to the underneath side of the upper portion 47 so as to also be centered about the axis 51. The two electrodes 52 and 54 thus overlap and are coaxial with each other. A uniform gap D1, equal to the difference between the outer radius $R_A$ of the inner electrode 52 and the inner radius $R_C$ of the outer electrode 54, is thus maintained between the two electrodes. This gap D1 is typically on the order of 2 to 6 mm. Note that the spacing D2 between the top of the inner electrode 52 and the top of the upper portion 47 is less than the spacing D1. As suggested by the scaling in FIG. 5, D2 may typically be on the order of one half the value of D1. Note also that all sharp corners are eliminated between any fronting surfaces of the two electrodes. This helps avoid any undesired long discharge paths from being formed.

Figure 6:
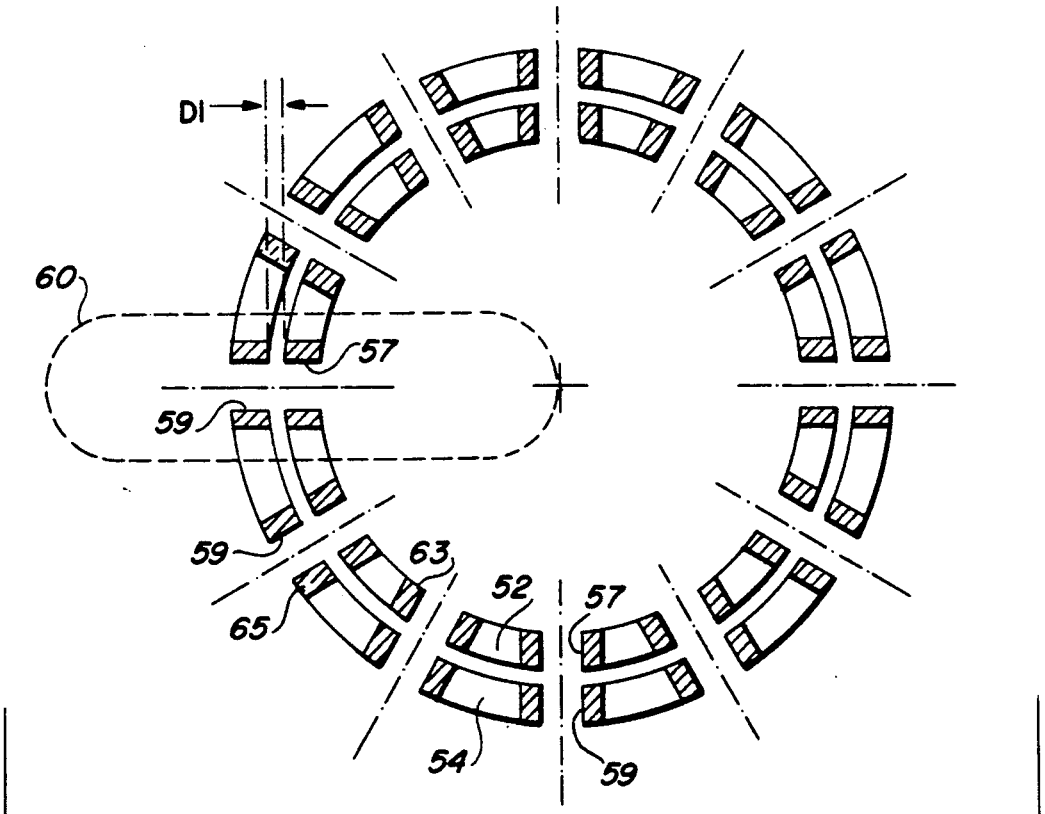
FIG. 6 is a schematic top plan view of the coaxial electrodes used within the pseudospark discharge switch of FIG. 5.

A plurality of rows 56 of holes 57 are uniformly spaced along the length of the first cylindrical electrode 52, as best seen in FIG. 6 (Note that FIG. 6 is not scaled the same as FIG. 5.) These rows are identified in FIG. 5 by the reference numerals 56*a*, 56*b*, 56*c*, 56*d*, and 56*e*. The holes in each row 56 are uniformly spaced around the circumference of the first cylindrical electrode 52, as best seen in FIG. 6. (Note that FIG. 6 is not scaled the same as FIG. 5.) Each row 56 includes twelve separate holes 57 that are uniformly spaced around the circumference of the cylindrical electrode 52. While five such rows 56*a*, 56*b*, 56*c*, 56*d* and 56*e* of twelve holes each are suggested in the schematic view of FIG. 5, it is to be understood that more or less than this number of holes in each row, or more or less than this number of rows, could be used in a coaxial pseudospark discharge device made in accordance with the present invention.

A corresponding number of rows 58 of holes 59 are uniformly spaced along the length of the second cylindrical electrode 54. These rows are identified in FIG. 5 by the reference numerals 58*a*, 58*b*, 58*c*, 58*d*, and 58*e*. Each row 58 also includes twelve separate holes 59 that are uniformly spaced around the circumference of the cylindrical electrode 54. Each hole 57 in the first cylindrical electrode is radially aligned with a corresponding hole 59 in the second cylindrical electrode, as shown best in the top plan view of the coaxial electrodes 52 and 54 shown in FIG. 6. In a preferred configuration, as shown in FIG. 6, the diameter of the holes 59 in the outer electrode 54 is the same as the diameter of the holes 57 in the inner electrode 52. An alternative embodiment provides a hole 59 in the outer electrode 54 that is slightly larger than the diameter of the holes 57 in the inner electrode 52. This slight difference in hole size for such alternative embodiment radially aligns the edges of the holes 57 and 59 as well as the centers of the holes 57 and 59.

Each pair of radially aligned holes 57 and 59 functions as a single PSD channel 60 through which a pseudospark discharge may occur. All of the single PSD channels included within a given row function as an annular PSD channel through which a multiplicity, e.g., twelve, pseudospark discharges may occur. Annular rings or baffles 62, as shown in FIG. 5, protrude inwardly from the outer portion 47 of the device 40. These rings function as walls or partitions that provide a degree of separation between the PSD channels 60 associated with one row of holes from the PSD channels associated with an adjacent row of holes. Further, the baffles 62 increase the surface area within the cathode and prevent long discharge paths.

Optionally, the holes 57 are lined with a refractory insert 63. Similarly, the holes 59 are lined with a refractory insert 65. The refractory inserts may be made of graphite, tungsten, or molybdenum. In lieu of refractory inserts, an in situ deposition by chemical vapor deposition (CVD) may be effected by the switching discharge. For example, if the gas within the switch is tungstenhexafluoride ($WF_6$), metallic tungsten is deposited at the point of current attachment to the electrodes, and this deposit may function as the refractory insert.

The annular insulator 43 is positioned between a protruding lip 66 of the first portion 47 of the PSD switch housing and an extension of the lower plate portion 49. Upper and lower O-rings 68 and 69, respectively, assure a tight seal between the housing portions 47 and 49. The conductor 45 (or 45') and the conductor 46 of the flat plate transmission line (FIG. 4) are fastened to the lip 66 and lower plate portion 49 using conventional fastening means.

A trigger device 48 is centrally located on-axis with the central axis 51 of the coax PSD device 40. For some embodiments of the invention, this trigger device 48 may be located within a trigger well 70. The trigger device 48 may be any suitable device or mechanism that introduces an adequate number of charge carriers into the center of the first hollow cylindrical electrode 2. For example, a surface discharge device, an optical discharge device (triggering by photons), a low current glow discharge pulsed to a high current value, or electron emission from a ferroelectric ceramic could be used. Such trigger devices are described in the art, see, e.g., Bloess, et al., supra; or Braun, et al. "Fiber-Optic-Triggered High-Power Low-Pressure glow Discharge Switches", *IEEE Transactions on Electronic Devices,* Vol. 35, No. 4, pp. 559–62 (April 1988). A preferred trigger device is a ferroelectric ceramic, as described, e.g., in Gundel et al., "Low-Pressure Hollow Cathode Switch Triggered by a Pulse Electron Beam Emitted From Ferroelectrics," *Appl. Phys. Lett,* Vol. 54 (21), 2071–73 (May, 22, 1989).

While any type of trigger device could be used, the location of the trigger device is critical for proper operation of the coax PSD switch 40. Preferably, the trigger device 48 should be in an area free from the electric field. Further, the trigger device should be positioned so as to guide the charge carriers to the holes, where the pseudospark discharge occurs. Advantageously, the coaxial configuration shown in FIG. 5, wherein the trigger device 48 is located within the trigger well 70, satisfies these requirements. (It is noted that the trigger well 70 need not be as deep as shown in FIG. 5; in some instances, a trigger well may not be required.

The annular insulator 43 is positioned well away from the discharge area (the PSD channels), thereby avoiding the build-up of discharge contaminants thereon. Further, the insulator 43 includes a discharge labyrinth 74. This labyrinth 74 provides a desired insulating length between the two charged electrodes. For proper operation, a long insulating length is desired. Thus, the labyrinth 74 may assume various shapes and configurations as desired in order to provide the desired insulating length.

Advantageously, the PSD switch 40 does not require a strong containment structure because the magnetic forces (generated upon the occurrence of a pseudospark discharge) are balanced. Further, because the switch operates at low internal pressure, less than atmospheric pressure, the atmospheric pressure tends to compress the switch structure, thereby compensating for any internal pressures that might tend to expand the switch structure at the occurrence of a pseudospark discharge.

In operation, most of the switching losses associated with the switch 40 are deposited as heat in the electrodes. These electrodes are fully metallic without any temperature sensitive parts. Thus, the switch structure can operate at elevated temperature, with efficient heat dissipation to the ambient or to a water (or other liquid) cooling jacket. If such a cooling jacket is desired, it may advantageously be applied to the outside of the switch housing. Any temperature sensitive components, such as the insulator 43 and the trigger device 48, are conveniently located away from the high temperature areas.

The geometry of the coaxial PSD switch 40 shown in FIG. 5 provides a most compact arrangement for many parallel PSD channels. Per channel operation of up to 200 kA is obtainable for a 10 mm diameter hole. Even if only a fraction of this current is achieved for each channel, e.g., 10 to 100 kA, the coaxial configuration allows a large number of discharge channels to be operated in parallel in order to reach current levels in the range of $10^6$ amperes. Further, the size of the switch 40 can be scaled as required, e.g., by increasing the length of the coaxial electrodes, thereby adding additional rows of PSD channels, in order to reach a desired current magnitude.

For practical reasons, the voltage potential applied between the electrodes of the PSD switch is generally limited to about 50 kV. Fortunately, many applications of a PSD switch, e.g., electric guns, require only up to about 30 kV. Hence, the PSD switch of the present invention is ideally suited for these applications.

For an ideal power source 32 (FIG. 4), and assuming there are no temperature concerns, the repetition rate of the switch 40 may be up to $10^5$ Hz. A preferred material for the insulator 43 is filled epoxy or ceramic, although many other insulating materials may be used. For high current operation, a lower repetition rate will likely be set by the rate at which heat can be removed from the housing of the switch.

The PSD switch 40 herein described may be used for numerous applications. Commercial applications include high power lasers and high voltage DC/AC converters. Military applications include electromagnetic and electrothermal guns. Such guns may require the switching of from 100 kA to 5.0 MA with a voltage range of 6 kV (electromagnetic guns) to 50 kV (electrothermal guns). Advantageously, the PSD switch described herein conveniently meets these switching requirements.

Further, any pulse power application using ignitrons, thyratrons, vacuum switches, and/or high pressure spark gap switches may benefit from the PSD switch described herein. A comparison of the specifications of the PSD switch of the present invention relative to the those attained using such conventional types of high-power switches is shown in Table 1. As is evident from Table 1, the PSD switch compares very favorably to such other types of switches.

TABLE 1

| | Pseudospark | Thyratron | Ignitron | High Pressure Spark Gap | Triggered Vaccuum Gap |
|---|---|---|---|---|---|
| Max. Operating Voltage (kV) | 50 | <50 | <50 | >1,000 | 50 |
| Min. Trigger Voltage (kV) | 0.2 | 0.2 | 0.5 | 30 | 0.2 |
| Peak Current (kA) | 1,000 | 10 | 300 | 1,000 | 10 |
| Max. Rep Rate (Hz) | $10^5$ | $2 \cdot 10^4$ | 1 | $10^3$ limited by gas flow rate | $10^5$ |
| Average Current (A) | >10 | 25 | Low | Low | Low |
| Max. Charge (A·s)/shot | 2 | $5 \cdot 10^{-2}$ | 300 | 1,400 | 2 |
| Min. Delay (ns) | 1 | 50 | 500 | 30 | 100 |
| Min. Jitter (ns) | <1 | >1 | 50 | >1 | 10 |
| dI/dt($10^{11}$)A/s) | 40 | 2 | 12 | 100 | 1 |
| Switch Life (Shots) | $>10^6$ | $10^{10}$ at low current | Long | Low | Low |

TABLE 1-continued

| | Pseudospark | Thyratron | Ignitron | High Pressure Spark Gap | Triggered Vaccuum Gap |
|---|---|---|---|---|---|
| Cathode | Cold | Hot | Liquid Hg | Cold | Cold |
| Reverse Current Capability | 100% | 10% | No | 100% | 100% |
| Fabrication Requirements | Low | High | Moderate | Moderate | High |

It is thus seen that the present invention provides a high power pseudospark switch that offers reduced contact erosion, greater charge transfer, longer switch life, reduced internal pressure, faster repetition rates, reduced trigger energy, and reduced housing strength, over conventional gas filled or triggered spark gap switches. Such high power pseudospark switch is realized using a coaxial geometry that offers many parallel pseudospark discharge (PSD) channels in a compact housing. Advantageously, the coaxial geometry allows for the simultaneous triggering of the many parallel PSD channels from a central triggering location. Further, the coaxial geometry facilitates the use of a coaxial electrode structure that provides a small uniform gap over the regions of high electrical field strength while operating on the left branch of the Paschen curve, thereby assuring that the desired pseudospark discharge occurs. Moreover, the coaxial geometry facilitates matching the high power pseudospark switch with a low inductance transmission line.

As also evident from the above description, it is seen that the coaxial geometry used for the high power pseudospark switch prevents discharge products from coating the annular insulator that maintains the coaxial electrodes in their spaced-apart relationship. This coaxial geometry further facilitates the use of water cooling or heat pipes in order to efficiently remove heat from the switch cavity.

While the invention herein disclosed has been described by means of specific embodiments and applications thereof, numerous modifications and variations could be made thereto by those skilled in the art without departing from the scope of the invention set forth in the claims.

What is claimed is:

1. A coaxial pseudospark discharge (PSD) switch comprising:

a sealed housing having a central axis, said housing having first and second sections maintained in electrical isolation from each other, a specified gas being maintained within said housing at a prescribed pressure;

a first, hollow, cylindrical electrode mounted inside of said housing so as to be in alignment with said central axis and in electrical contact with said first housing section;

a second, hollow, cylindrical electrode mounted inside of said housing so as to be coaxial with, yet spaced-apart from, said first cylindrical electrode, a uniform gap existing between an outer surface of said first cylindrical electrode and an inner surface of said second cylindrical electrode, said second cylindrical electrode being in electrical contact with said second housing section;

an annular PSD channel comprising a row of a multiplicity of holes uniformly spaced around the circumference of said first and second cylindrical electrodes, each hole in said first cylindrical electrode of said PSD channel being radially aligned with a corresponding hole in said second cylindrical electrode of said PSD channel;

means for applying a prescribed voltage potential between said first and second housing sections, whereby said prescribed voltage potential is placed between said spaced-apart cylindrical electrodes; and triggering means for selectively triggering a pseudospark discharge between said spaced-apart cylindrical electrodes, said uniform gap and prescribed gas pressure and voltage potential promoting said pseudospark discharge in response to said triggering means, said pseudospark discharge tending to center itself on a radial axis passing through the radially aligned holes of the first and second cylindrical electrodes;

whereby an electrical charge may be selectively passed between said first and second housing sections by means of said triggered pseudospark discharge.

2. The coaxial PSD switch as set forth in claim 1 further including a plurality of said annular PSD channels, each comprising an additional row of said multiplicity of holes, spaced along the length of said central axis within said housing.

3. The coaxial PSD switch as set forth in claim 2 wherein said triggering means selectively increases the charge carrier density within said first hollow cylindrical electrode in response to a triggering signal.

4. The coaxial PSD switch as set forth in claim 3 wherein said triggering means is located on-axis with said first and second cylindrical electrodes.

5. The coaxial PSD switch as set forth in claim 4 wherein said triggering signal is electrical.

6. The coaxial PSD switch as set forth in claim 4 wherein said triggering signal is optical.

7. The coaxial PSD switch as set forth in claim 3 wherein said sealed housing housing is cylindrical, and said first section including a bottom portion of said cylindrical housing, said second section including a top portion of said cylindrical housing, said first cylindrical electrode being supported by said first section, said second cylindrical electrode being supported by said second section, an annular ring extending out from said cylindrical housing and forming an integral part thereof, said annular ring having top and bottom conductive portions with an annular insulating member therebetween, the bottom conductive portion of said annular ring being connected to said first section of said cylindrical housing, and the top conductive portion of said annular ring being connected to said second section of said cylindrical housing.

8. The coaxial PSD switch as set forth in claim 7 wherein said annular ring includes means for attaching a transmission line thereto, said transmission line providing a means for coupling power to and from said PSD switch.

9. The coaxial PSD switch as set forth in claim 8 wherein said transmission line comprises a low inductive flat plate transmission line.

10. The coaxial PSD switch as set forth in claim 7 wherein said second section of said cylindrical housing includes inner annular baffles associated with said plurality of the annular PSD channels, said annular baffles being positioned above and below each row of aligned holes of said first and second cylindrical electrodes so as to form a discharge cavity in alignment with said holes into which said pseudospark discharge may enter.

11. The coaxial PSD switch as set forth in claim 7 further including a discharge labyrinth within said annular ring.

12. The coaxial PSD switch as set forth in claim 7 further including refractory inserts lining said holes in said first and second cylindrical electrodes.

13. Apparatus for generating a pseudospark discharge comprising:

coaxial cylindrical electrodes comprising a first, hollow, cylindrical electrode;

a second, hollow, cylindrical electrode coaxial with and overlapping said first cylindrical electrode, thereby forming an overlapping electrode portion, a uniform gap existing between an outer surface of said first cylindrical electrode and an inner surface of said second cylindrical electrode;

a multiplicity of holes uniformly spaced around the circumference of said first and second cylindrical electrodes, each hole in said first cylindrical electrode being radially aligned with a corresponding hole in said second cylindrical electrode, said multiplicity of holes comprising a PSD channel;

means for maintaining a prescribed gas at a prescribed pressure in the gap between said first and second coaxial electrodes;

means for applying a prescribed voltage potential between said first and second cylindrical electrodes; and triggering means centrally positioned at one end of said coaxial electrodes for selectively triggering a pseudospark discharge between said spaced-apart cylindrical electrodes, said gap spacing and prescribed gas pressure and voltage potential promoting said pseudospark discharge in response to said triggering means, said pseudospark discharge tending to center itself on a radial axis passing through each of the radially aligned holes of the first and second cylindrical electrodes.

14. The apparatus for generating a pseudospark discharge as set forth in claim 13 further including a plurality of said PSD channels spaced along the overlapping electrode portion.

15. The apparatus for generating a pseudospark discharge as set forth in claim 13 wherein said triggering means increases the charge carrier density within said first hollow cylindrical electrode in response to a triggering signal.

16. The apparatus for generating a pseudospark discharge as set forth in claim 15 wherein said triggering signal comprises an electrical signal.

17. The apparatus for generating a pseudospark discharge as set forth in claim 16 wherein said triggering means comprises a ferroelectric device positioned on-axis with said coaxial electrodes.

18. The apparatus for generating a pseudospark discharge as set forth in claim 15 wherein said triggering signal comprises an optical signal.

19. A method of generating a pseudospark discharge comprising:

(a) forming overlapping cylindrical coaxial electrodes by making a first, hollow, cylindrical electrode, placing a second, hollow, cylindrical electrode coaxial with and overlapping said first cylindrical electrode so that a uniform gap exists between an outer surface of said first cylindrical electrode and an inner surface of said second cylindrical electrode, and uniformly spacing a multiplicity of holes around the circumference of said first and second cylindrical electrodes so that each hole in said first cylindrical electrode is radially aligned with a corresponding hole in said second cylindrical electrode, said multiplicity of holes comprising a PSD channel;

(b) maintaining a prescribed gas at a prescribed pressure in the gap between said first and second coaxial electrodes;

(c) applying a prescribed voltage potential between said first and second cylindrical electrodes; and (d) selectively increasing the charge carrier density in the central region of the coaxial electrodes, thereby triggering a pseudospark discharge between said first and second cylindrical electrodes, said gap spacing and prescribed gas pressure and voltage potential promoting said pseudospark discharge in response to said increased charge carrier density, said pseudospark discharge tending to center itself on a radial axis passing through each of the radially aligned holes of the first and second cylindrical electrodes.

20. The method of generating a pseudospark discharge as set forth in claim 19 further including spacing a plurality of said PSD channels along the length of said overlapping coaxial electrodes.

21. The method of generating a pseudospark discharge as set forth in claim 20 wherein the step of selectively increasing the charge carrier density comprises emitting electrons into the center of the first hollow cylindrical electrode from an on-axis trigger located near one end of said first hollow cylindrical electrode.

22. The method of generating a pseudospark discharge as set forth in claim 21 wherein the step of emitting electrons into the center of the first hollow cylindrical electrode comprises placing a ferroelectric trigger device on-axis with said first cylindrical electrode and selectively triggering said ferroelectric trigger device with an electrical pulse.

* * * * *